United States Patent [19]

Edwards et al.

[11] Patent Number: 4,576,744

[45] Date of Patent: Mar. 18, 1986

[54] DETERGENT COMPOSITIONS

[75] Inventors: Robert J. Edwards; Paul D. Hardman, both of Merseyside, England

[73] Assignee: Lever Brothers Company, New York, N.Y.

[21] Appl. No.: 602,575

[22] Filed: Apr. 20, 1984

[30] Foreign Application Priority Data

Apr. 29, 1983 [GB] United Kingdom ..... 8311854

[51] Int. Cl.[4] ..... C11D 1/14; C11D 3/37

[52] U.S. Cl. ..... 252/554; 252/173; 252/174.17; 252/174.23; 252/174.24; 252/535; 252/538; 252/557; 252/DIG. 2; 252/DIG. 3; 252/DIG. 13; 252/DIG. 14

[58] Field of Search ..... 252/DIG. 14, DIG. 2, 252/DIG. 3, DIG. 13, DIG. 15, 173, 174.17, 174.23, 530, 532, 533, 538, 535, 552, 554, 557

[56] References Cited

U.S. PATENT DOCUMENTS

| | | | |
|---|---|---|---|
| 3,503,895 | 3/1970 | Whelan | 252/363.5 |
| 3,950,260 | 4/1976 | Eldib | 252/89 R |
| 3,969,500 | 7/1976 | Kennerley | 252/DIG. 2 |
| 3,980,769 | 9/1976 | Ghilardi et al. | 252/DIG. 2 |
| 4,022,731 | 5/1977 | Schmitt | 523/336 |
| 4,228,048 | 10/1980 | Tesdahl | 252/DIG. 2 |
| 4,260,528 | 4/1981 | Fox et al. | 252/525 |
| 4,284,534 | 8/1981 | Ehrlich | 252/DIG. 14 |
| 4,414,144 | 11/1983 | Liebowitz et al. | 252/DIG. 14 |
| 4,434,087 | 2/1984 | Hampson et al. | 252/DIG. 14 |
| 4,472,297 | 9/1984 | Bolich, Jr. et al. | 252/DIG. 14 |

FOREIGN PATENT DOCUMENTS

| | | |
|---|---|---|
| 13836 | 8/1980 | European Pat. Off. . |
| 51983 | 5/1982 | European Pat. Off. . |
| 71413 | 2/1983 | European Pat. Off. . |
| 71414 | 2/1983 | European Pat. Off. . |
| 89213 | 9/1983 | European Pat. Off. . |
| 8303621 | 3/1983 | PCT Int'l Appl. . |
| 1054244 | 1/1967 | United Kingdom . |
| 1073655 | 6/1967 | United Kingdom . |
| 1071660 | 6/1967 | United Kingdom . |
| 1250614 | 10/1971 | United Kingdom . |
| 1270040 | 4/1972 | United Kingdom . |
| 1380402 | 1/1975 | United Kingdom . |
| 1429639 | 3/1976 | United Kingdom . |
| 1460893 | 1/1977 | United Kingdom . |
| 1471406 | 4/1977 | United Kingdom . |
| 1512355 | 6/1978 | United Kingdom . |
| 1576946 | 10/1980 | United Kingdom . |
| 1584127 | 2/1981 | United Kingdom . |
| 2095276 | 9/1982 | United Kingdom . |
| 2103236 | 2/1983 | United Kingdom . |
| 2104913 | 3/1983 | United Kingdom . |
| 2105325 | 3/1983 | United Kingdom . |
| 2108520 | 5/1983 | United Kingdom . |
| 2126243 | 3/1984 | United Kingdom . |
| 2130236 | 5/1984 | United Kingdom . |

OTHER PUBLICATIONS

Jaguar HP-60, Product Data Bulletin (Clear Shampoo, Clear Gel Shampoo, Comparative Performance of Jaguar HP-60 Versus Hydroxypropyl Methylcellulose), Celanese Polymer Specialties Company, Stein-Hall, One Riverfront Plaza, Louisville, KY 40202.

*Primary Examiner*—Paul Lieberman
*Assistant Examiner*—Hoa Van Le
*Attorney, Agent, or Firm*—Milton L. Honig; James J. Farrell

[57] ABSTRACT

Certain polymers, notably hydroxyethyl and hydroxypropyl celluloses, hydroxypropyl guars, xanthan gums, and certain acrylic polymers, enhance the foam stability of liquid detergents based on dialkyl sulphosuccinates while simultaneously providing increased viscosity.

18 Claims, No Drawings

DETERGENT COMPOSITIONS

The present invention relates to aqueous liquid detergent compositions containing one or more dialkyl sulphosuccinates. The compositions of the invention are especially, but not exclusively, useful for manual dishwashing in both hard and soft water.

The term "dishes" as used herein means any utensils involved in food preparation or consumption which may be required to be washed to free them from food particles and other food residues, greases, proteins, starches, gums, dyes and burnt organic residues.

The use of dialkyl sulphosuccinates as active ingredients in liquid detergent compositions suitable inter alia for manual dishwashing is disclosed in GB No. 1 429 639, GB No. 2 108 520, GB No. 2 104 913, GB No. 2 105 325, EP No. 71413 and EP No. 71414 (Unilever).

It has now been discovered that the viscosity of these liquid products can be increased by the inclusion of relatively low levels of certain water-soluble polymers, and that, surprisingly, the presence of these polymers gives enhanced foaming and detergency.

U.S. Pat. No. 3,503,895 (Whelan, American Cyanamid Co) discloses readily dispersible, water-soluble gum compositions in finely divided form containing from 0.001 to 1.0% by weight of sodium dioctyl sulphosuccinate. The gum is a naturally-occurring vegetable gum such as guar or karaya gum, or a synthetic cellulosic polymer such as hydroxypropyl methyl cellulose or hydroxyethyl cellulose.

GB No. 1 071 660 (The Pyrene Co. Ltd) discloses foam compositions for extinguishing fires. These compositions contain a quaternary ammonium salt containing a $C_{12}$–$C_{18}$ aliphatic radical, a further surface-active agent, and a polymer which can be a cellulosic material (for example, hydroxyethyl cellulose), a carboxy vinyl polymer or a polyacrylamide. The additional surfactant is preferably cationic or nonionic but anionic surfactants, for example, sodium dialkyl sulphosuccinate, may also be used.

GB No. 2 103 236A (Colgate-Palmolive Co.) discloses light-duty liquid detergents containing hydroxypropyl guar gum which improves the grease soil foam stability as well as increasing the viscosity of the compositions. The active detergent system is a combination of alkyl ether sulphate, alkyl sulphate and betaine; the hydroxypropyl guar gum is said to have no foam stabilising effect on other active detergent systems, such as alkylbenzene sulphonate/alkyl ether sulphate or alkylbenzene sulphonate/alkyl ether sulphate/lauric-myristic monoethanolamide.

GB No. 2,126,243A (Colgate-Palmolive Co.), published on Mar. 21, 1984, discloses a method for incorporating hydroxypropyl methyl celluloses into liquid detergent products.

The present invention provides a foaming aqueous liquid detergent composition having a viscosity of at least 60 cp at 25° C. as measured at a shear rate of 26.5 $s^{-1}$ and comprising (a) at least 2% by weight of an active detergent system comprising a water-soluble salt of a dialkyl ester of sulphosuccinic acid in which the alkyl groups may be the same or different, said salt constituting at least 2% by weight of the whole composition, and (b) from 0.05 to 5% by weight of a water-soluble polymer selected from (i) polysaccharides having hydrophilic substituents, (ii) xanthan gums, and (iii) synthetic polymers carrying carboxyl substituents in salt or amide form, said composition being free of quaternary ammonium salts containing $C_{12}$–$C_{18}$ aliphatic radicals.

The total active detergent level is at least 2% by weight and generally in the 2 to 60% by weight range. The invention is of especial interest for compositions in which the active detergent level is 30% or below, and more particularly from 2 to 20% by weight. At these lower concentrations the benefit of higher viscosity conferred by the inclusion of a polymer is especially important.

The compositions of the invention contain as a first essential ingredient a detergent active salt of a dialkyl ester of sulphosuccinic acid, hereinafter referred to as a dialkyl sulphosuccinate. This component constitutes at least 2% by weight of the whole composition, and preferably the active detergent system consists either wholly or predominantly of dialkyl sulphosuccinate. The dialkyl sulphosuccinate may if desired be constituted by a mixture of materials of different chain lengths, of which the individual dialkyl sulphosuccinates themselves may be either symmetrical (both alkyl groups the same) or unsymmetrical (with two different alkyl groups).

The detergent-active dialkyl sulphosuccinates are compounds of the formula I:

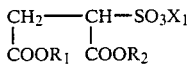

$$\begin{array}{l} CH_2 — CH — SO_3X_1 \\ \quad | \qquad\quad | \\ COOR_1 \quad COOR_2 \end{array} \qquad (I)$$

wherein each of $R_1$ and $R_2$, which may be the same or different, represents a straight-chain or branched-chain alkyl group having from 3 to 12 carbon atoms, preferably from 4 to 10 carbon atoms and especially from 6 to 8 carbon atoms, and $X_1$ represents a solubilising cation, that is to say, any cation yielding a salt of the formula I sufficiently soluble to be detergent-active. The solubilising cation $X_1$ will generally be monovalent, for example, alkali metal, especially sodium; ammonium; or substituted ammonium, for example, ethanolamine. Certain divalent cations, notably magnesium, are however also suitable.

The alkyl groups $R_1$ and $R_2$ are preferably straight-chain or (in mixtures) predominantly straight-chain.

Among dialkyl sulphosuccinates that may advantageously be used in the composition of the invention are the $C_6/C_8$ unsymmetrical materials described and claimed in GB No. 2 105 325 (Unilever); the dioctyl sulphosuccinate/dihexyl sulphosuccinate mixtures described and claimed in GB No. 2 104 913 (Unilever); and the mixtures of symmetrical and unsymmetrical dialkyl sulphosuccinates described and claimed in GB No. 2 108 520 (Unilever).

Other detergent-active materials may if desired be present in addition to the dialkyl sulphosuccinate, but preferably in lesser amounts. This will be discussed in more detail below.

The second essential ingredient of the compositions of the invention is a water-soluble polymer selected from one of the three classes defined previously. The polymer is preferably nonionic in character, although some anionic polymers are effective; the polymer must not be cationic.

The compositions of the invention are non-Newtonian liquids the viscosities of which vary with applied shear. As an arbitrary reference point for the purposes of the present invention an applied shear of 26.5 $s^{-1}$ has been chosen. At this shear rate the compositions of the invention have viscosities at 25° C. of at least 60 cp, preferably from 70 to 2000 cp, more preferably from 100 to 1500 cp. The lower end of this range is determined by consumer acceptability, while the upper end is limited only by processing considerations. For hand dishwashing compositions the viscosity range of from 200 to 500 cp is of especial interest, while for other products such as shampoos the preferred viscosity region may be higher.

The level of polymer present in the compositions of the invention should be chosen so as to be sufficient to give both a foam stability enhancement effect and a viscosity of at least 60 cp. For the first requirement a level of at least 2% by weight of the active detergent present appears to be necessary, that is to say, at least 0.04% by weight of the whole composition, and there appears to be no inherent upper limit. For the second requirement, from 0.05 to 5% by weight of polymer appears to be appropriate. Too high a level of polymer will give too viscous a product, and at high levels the polymer may be incompatible with other ingredients of the composition. The optimum level of any particular polymer in any particular composition may very easily be determined by routine experiment.

The preferred level, taking into account these various criteria, appears to be from 0.1 to 1.5% by weight, based on the whole composition.

At the levels appropriate for foam stability enhancement and viscosity, the polymer must be compatible with the other ingredients of the formulation and must itself be soluble enough not to precipitate out in the presence of those other ingredients. Preferably the polymer dissolves to give a clear solution and does not cloud or opacify the composition, although this is not essential if the product is to be packed in an opaque bottle. The compositions are preferably substantially free of other insoluble ingredients, and the preferred form of the composition of the invention is a clear homogeneous aqueous solution containing at least 40% by weight of water, preferably at least 50% by weight of water.

The first class of polymers, the hydrophilically substituted polysaccharides, is preferred, and two subclasses of these materials are of special interest:

(i) (a) celluloses having hydrophilic substituents, and (ii) (b) guars (galactomannans) having hydrophilic substituents.

The preferred hydrophilic substituents are hydroxyethyl and hydroxypropyl groups, the latter being especially effective.

Examples of suitable commercially available hydroxyethyl and hydroxypropyl celluloses are the Methocel (Trade Mark) Series ex Dow, the Natrosol (Trade Mark) Series ex Hercules, the Klucel (Trade Mark) series ex Hercules and the Bermocoll (Trade Mark) Series ex Berol Kemi.

The Methocels, which are methyl hydroxypropyl celluloses, are available at a number of different levels of hydroxypropyl substitution and it has been found that the higher this level, the greater the foam stability enhancement effect. Preferably the level of hydroxypropyl molar substitution is greater than 0.15, more preferably at least 0.18. The preferred grade of Methocel is Methocel J (level of hydroxypropyl molar substitution 0.75–1.00), and Methocel E (0.22–0.25) and K (0.18–0.23) are also effective. Levels of methyl and hydroxypropyl substitution may be determined by the method of ASTM D 2363-72.

Another preferred group of cellulose derivatives of interest for use in the present invention are the Natrosols, mentioned above, which are hydroxyethyl celluloses. The grades available include Natrosol 180, 250 and 300, which differ as to level of substitution (180 <250 <300; about 2.5 for the 250 types). The Bermocolls, also mentioned above, are ethyl hydroxyethyl celluloses available at different levels of substitution.

Celluloses carrying only alkyl substituents, such as methyl and ethyl celluloses, do not exhibit the foam stability enhancement effect characteristic of the invention. Hydroxybutyl celluloses also appear to be ineffective.

As indicated previously, a second group of polysaccharides that may advantageously be used in the invention is constituted by the guars (galactomannans) having hydrophilic substituents, in particular hydroxypropyl groups. The Jaguar (Trade Mark) range of hydroxypropyl guars, ex Meyhall, which have molar levels of hydroxypropyl substitution of about 0.35–0.60, exemplify this class of polymers and give good results in the context of the present invention.

The second type of polymer of interest in the context of the present invention is xanthan gum. An example of a suitable material is Kelzan (Trade Mark) S ex Kelco.

The third general class (iii) of polymers that may be used in the invention is constituted by synthetic polymers in which the polymer backbone carries carboxyl substituents in salt or amide form. These polymers, which may be linear or crosslinked, fall into two preferred subgroups:

(iii) (a) acrylic polymers, namely, salts of polyacrylic acid, salts of polymethacrylic acid, polyacrylamides, and copolymers of acrylic and/or methacrylic acid salts with acrylamide; and (iii) (b) ethylene - maleic anhydride copolymers.

Some examples of acrylic polymers suitable for use in the invention are as follows:

linear salts of polyacrylic acid, for example, the Versicol (Trade Mark) S series ex Allied Colloids;

linear polyacrylamides, for example, the Versicol (Trade Mark) W series ex Allied Colloids;

linear acrylic acid salt/acrylamide copolymers, for example, the Crosfloc (Trade Mark) series ex Joseph Crosfield & Sons Ltd; and salts of crosslinked polyacrylic acid, for example, the Carbopol (Trade Mark) series ex B F Goodrich (crosslinked with polyalkenyl polyethers).

An example of an ethylene-maleic anhydride copolymer for use in the invention is EMA (Trade Mark) 91 ex Monsanto.

In order to optimise formulation and compatibility of ingredients, the compositions of the invention advantageously contain urea. The level of urea chosen depends primarily on the total level of active detergent present, and the proportion of that constituted by dialkyl sulphosuccinate. The urea level is suitably from 1 to 30% by weight, preferably from 2 to 20% by weight. The use of urea as a hydrotrope or solubiliser is well-known in the liquid detergent art; its presence enables single-phase compositions to be prepared that contain higher levels of active ingredients than would otherwise be possible.

Some other materials well-known as hydrotropes, notably the lower aliphatic alcohols, tend to reduce viscosity, and when the total active detergent level is 20% or less the compositions of the invention are preferably substantially free of these materials. Dialkyl sulphosuccinates may, however, contain a certain amount of ethanol as a result of their method of manufacture, and in these circumstances a higher level of polymer may be required for viscosity control than if alcohol-free material were used.

As previously indicated, it may be advantageous to include in the compositions of the invention one or more other detergent-active materials in addition to dialkyl sulphosuccinate, provided that the level of this material is at least 2% by weight, and provided that no quaternary ammonium salts containing $C_{12}$–$C_{18}$ aliphatic radicals are present. These cationic materials are highly detrimental to foaming.

If desired the composition of the invention may additionally include one or more of the sulphonate-type detergents conventionally used as the main detergent-active agent in liquid compositions, for example, alkylbenzene sulphonates (especially $C_9$–$C_{15}$ linear alkylbenzene sulphonates), secondary alkane sulphonates, alpha-olefin sulphonates, alkyl glyceryl ether sulphonates, and fatty acid ester sulphonates. Of course dialkyl sulphosuccinates are themselves sulphonate-type detergents. If such additional sulphonate-type materials are present, the total sulphonate preferably predominates in the active detergent mixture of the composition of the invention. If no such additional sulphonate-type materials are present, the sulphosuccinate alone preferably predominates.

Of these materials, alkylbenzene sulphonates are of especial interest. Mixtures of dialkyl sulphosuccinate and alkylbenzene sulphonate in ratios of 0.5:1 to 2:1 have been found to give stable products according to the invention exhibiting excellent foaming and detergency.

If desired there may also be present one or more primary or secondary alkyl sulphates. If present, these, together with any sulphonate material as mentioned above, including the dialkyl sulphosuccinate, preferably predominate in the active detergent mixture of the composition of the invention.

The composition of the invention advantageously contains one or more further detergent-active materials in addition to the dialkyl sulphosuccinate, optional additional sulphonate and/or alkyl sulphate already mentioned. Of especial interest in this connexion are alkyl polyethoxy sulphates (ether sulphates). It has been found that the foam stability enhancement characteristic of the invention is especially marked if the alkyl ether sulphates are present. The ratio of the total main detergent-active material (dialkyl sulphosuccinate, plus optional sulphonate-type detergent and/or alkyl sulphate) to the ether sulphate is advantageously at least 1:1, a range of 1.5:1 to 10:1 being especially preferred.

Preferred alkyl ether sulphates are materials of the general formula:

$$R_3—O—(CH_2CH_2O)_n—SO_3X_2$$

wherein $R_3$ is a $C_{10}$ to $C_{18}$ alkyl group, $X_2$ is a solubilising cation, and n, the average degree of ethoxylation, is from 1 to 12, preferably 1 to 8. $R_3$ is preferably a $C_{11}$ to $C_{15}$ alkyl group. In any given alkyl ether sulphate, a range of differently ethoxylated materials, and some unethoxylated material, will be present and the value of n represents an average. The unethoxylated material is, of course, alkyl sulphate. If desired, additional alkyl sulphate may be admixed with the alkyl ether sulphate, to give a mixture in which the ethoxylated distribution is more weighted towards lower values.

It is especially preferred, according to the present invention, to use alkyl ether sulphates containing less than 20% by weight of $C_{14}$ and above material, as described and claimed in GB No. 2 130 238A (Unilever).

Examples of preferred ether sulphates for use in the present invention are Dobanol (Trade Mark) 23-3 and Dobanol 23-2 ex Shell, both based on $C_{12}$–$C_{13}$ (50% of each) primary alcohol (about 75% straight chain, 25% 2-methyl branched), and having average degrees of ethoxylation n of 3 and 2 respectively.

Nonionic detergents are also of interest for use in the compositions of the present invention, although less so than the alkyl ether sulphates.

These may advantageously be short-chain high-foaming nonionic detergents of the general formula:

$$R_4—O—(CH_2CH_2O)_m—H$$

wherein $R_4$ is an alkyl group, preferably straight-chain, having from 8 to 12 carbon atoms, and the average degree of ethoxylation m is from 5 to 12. An especially preferred nonionic detergent is Dobanol 91-8 ex Shell, in which $R_4$ is $C_9$–$C_{11}$ (predominantly straight-chain) and m is 8.

The compositions of the invention may also, if desired, contain fatty acid dialkanolamides, as described and claimed in GB No. 2 130 236A (Unilever).

Other detergent-active materials of lesser interest that may nevertheless be included in minor amounts in the compositions of the invention include alcohol propoxylates, alkylphenol ethoxylates and propoxylates, ethoxylated and propoxylated fatty acid amides, amine oxides, betaines and sulphobetaines.

The compositions of the invention may also contain the usual minor ingredients such as perfume, colour, preservatives and germicides.

The following Examples illustrate the invention.

In the Examples, the dialkyl sulphosuccinate used was a statistical $C_6/C_8$ mixture as described in Example 1 of GB No. 2 108 520A (Unilever). This consisted approximately of 25 mole % of di-n-hexyl sulphosuccinate, 25 mole % of di-n-octyl sulphosuccinate and 50 mole % of n-hexyl n-octyl sulphosuccinates (all sodium salts).

The alkyl ether sulphate used in some Examples was Dobanol (Trade Mark) 23-3A ex Shell, a sulphated $C_{12}$–$C_{13}$ primary alcohol 3EO ethoxylate (ammonium salt), or Dobanol 23-2S, the corresponding 2EO ethoxylate (sodium salt).

The nonionic surfactant used in Examples 4 and 13 was Dobanol (Trade Mark) 91-8 ex Shell, a $C_9$–$C_{11}$ primary alcohol 8EO ethoxylate.

The alkylbenzene sulphonate used in Examples 1 and 36-38 was Dobane (Trade Mark) 102 ex Shell, a linear $C_{10}$–$C_{12}$ alkylbenzene sulphonate (sodium salt).

Foaming and dishwashing performances were compared using a modified Schlachter-Dierkes test based on the principle described in *Fette und Seifen* 1951, 53, 207. A 100 ml aqueous solution of each test system, generally having a concentration of about 0.2 g/litre of total detergent active matter, in 24° H water at 45° C., was rapidly agitated using a vertically oscillating perforated disc within a graduated cylinder. After the initial generation of foam, increments (0.2 g) of soil (9.5 parts commercial cooking fat, 0.25 parts oleic acid, 0.25 parts stearic acid, 10 parts wheat starch and 120 parts water) were added at 15-second intervals (10 seconds' mild agitation and 5 seconds' rest) until the foam collapsed. The result was recorded as the number of soil increments (NSI score). Each result was typically the average of three or four runs.

EXAMPLES 1 & 2

In this Example the effect of two polymers on the foaming of dialkyl sulphosuccinate was compared with the effect of the same polymers, at the same level, on alkylbenzene sulphonate. Compositions 1 and 2 according to the invention each contained 0.24 g/litre of the dialkyl sulphosuccinate mix, and Comparative Compositions A and B each contained 0.24 g/litre of alkylbenzene sulphonate.

The polymers used were Natrosol 250 HBR, a hydroxyethyl cellulose identified previously, and Methocel J75 MS, a methyl hydroxypropyl cellulose having, as previously indicated, degrees of substitution of 0.93–1.15 (methyl, degree of substitution) and 0.75–1.00 (hydroxypropyl, molar substitution). The polymers, where present, were used at a level of 0.1 g/litre.

The results, expressed as the difference in NSI score between compositions containing the polymers and corresponding controls containing no polymer, were as follows:

| | Polymer | NSI score difference |
|---|---|---|
| 1 | Natrosol 250 HBR | +3.6 |
| A | Natrosol 250 HBR | +2.0 |
| 2 | Methocel J75 MS | +5.6 |
| B | Methocel J75 MS | +3.0 |

It will be seen that both polymers enhanced the foam stability of both compositions, but the effect on the dialkyl sulphosuccinate was nearly twice the absolute magnitude of the effect on the alkylbenzene sulphonate. Of the two polymers, Methocel J75 MS had the larger effect.

EXAMPLE 2

This example shows the detrimental effect on foaming of the presence of a $C_{12}$–$C_{18}$ quaternary ammonium salt, cetyl trimethyl ammonium bromide (CTAB) as used in Example XV of GB 1 071 660 (The Pyrene Co.).

EXAMPLE 2

| Composition (g/litre) | | | NSI score difference | | |
|---|---|---|---|---|---|
| Dialkyl sulpho-succinate | Ether Sulphate | CTAB | No polymer | +Methocel J75-MS | +Natrosol 250 HBR |
| 0.36 | — | — | (control) | +4.75 | +6.00 |
| 0.36 | 0.06 | — | +4.50 | +8.50 | +8.50 |
| 0.36 | — | 0.06 | −31.25 | −31.00 | −30.75 |

The results, shown relative to dialkyl sulphosuccinate alone as control, show that the foaming performance of that material fell dramatically in the presence of CTAB, and the presence of the polymers did not significantly improve matters. When alkyl ether sulphate (3EO, ammonium salt) was present instead of CTAB, foam stability was improved by the polymers.

EXAMPLE 3

In this Example, the foam stability enhancement of a mixed detergent system, dialkyl sulphosuccinate/alkyl ether sulphate, was investigated using a number of cellulosic polymers having different levels of substitution by hydrophilic (hydroxyethyl or hydroxypropyl) groups was investigated.

The active detergent level was 0.24 g/litre (0.16 g/litre dialkyl sulphosuccinate; 0.08 g/litre alkyl ether sulphate, 3EO, ammonium salt), and the polymer level in each case was 0.1 g/litre. The Table shows the difference in NSI score in each case as compared with a control composition containing no polymer.

The results for the different Methocels show clearly the correlation between level of hydroxypropyl substitution and foam stability enhancement of dialkyl sulphosuccinate. The negative result obtained with Methocel A4M shows that the level of methyl substitution is unimportant. A similar correlation with hydroxyethyl substitution is shown by the Bermocolls and Natrosol 250HBR, and it is evident that hydroxyethyl substitution is less potent than hydroxypropyl substitution.

A hydroxybutyl cellulose, Methocel HB, and a sodium carboxymethyl cellulose, Blanose (Trade Mark) 9HFD ex Hercules, were found to give no foam stability enhancement.

EXAMPLE 3

| Cellulosic polymer | Degree of substitution | | Molar substitution | | NSI Score difference |
|---|---|---|---|---|---|
| | methyl | ethyl | hydroxy-ethyl | hydroxy-propyl | |
| Methocel J75 MS | 0.93–1.15 | 0 | 0 | 0.75–1.00 | +8.0 |
| Methocel E4M | 1.86–1.90 | 0 | 0 | 0.22–0.25 | +4.5 |
| Klucel HF | 0 | 0 | 0 | ≦4.6 | +3.5 |
| Methocel F4M | 1.71–1.81 | 0 | 0 | 0.12–0.15 | +0.5 |
| Methocel A4M | 1.79–1.83 | 0 | 0 | 0 | −0.5 |
| Bermocoll E481 FQ | 0 | 0.8 | 2.0 | 0 | +5.0 |
| Bermocoll E320 G | 0 | 0.8 | 0.8 | 0 | +4.5 |
| Natrosol 250 HBR | 0 | 0 | 2.5 | 0 | +3.0 |

EXAMPLE 4

The NSI score of a composition containing dialkyl sulphosuccinate (0.15 g/litre) and nonionic surfactant (Dobanol 91-8, 0.08 g/litre) was measured in the presence and absence of the polymer Methocel J75 MS (0.1 g/litre). The polymer gave an improvement of 2.0 units of NSI score.

EXAMPLE 5

In this Example the foam enhancement properties of three hydroxypropyl guars, Jaguar HP8, HP11 and HP60 ex Meyhall, was compared with that of an unsubstituted guar, Meyproguar (Trade Mark) also ex Meyhall. As in Example 3, the active detergent level was 0.24 g/litre (0.16 g/litre dialkyl sylphosuccinate; 0.08 g/litre alkyl ether sulphonate, 3EO, ammonium salt, and the polymer level was 0.1 g/litre.

| Polymer | Hydroxypropyl Substitution | NSI score difference |
|---|---|---|
| Meyproguar | 0 | +1.0 |
| Jaguar HP8 | 0.35–0.60 | +4.5 |
| HP11 | 0.35–0.60 | +4.5 |

-continued

| Polymer | Hydroxypropyl Substitution | NSI score difference |
|---|---|---|
| HP60 | 0.35–0.60 | +9.0 |

It will be seen that the hydroxypropyl guars all gave a substantial improvement, while the unsubstituted guar had little effect. Jaguar HP60 was the most effective polymer, possibly owing to a higher level of hydroxypropyl substitution.

A cationically substituted guar, Jaguar C13S, was found to have a negative effect on foaming performance.

EXAMPLE 6

The effect of using different polymer levels was investigated using two different hydroxypropyl celluloses and a hydroxypropyl guar. The active detergents and their levels were as in Example 3.

| Polymer | Hydroxypropyl substitution | Polymer level (g/litre) 0.01 | 0.25 | 0.50 |
|---|---|---|---|---|
| Methocel | | | | |
| K15MS | 0.18–0.23 | +7.0 | +9.5 | +13.5 |
| J75MS | 0.75–1.00 | +6.5 | +18.0 | +26.0 |
| Jaguar HP60 | 0.35–6.00 | +5.0 | +16.0 | +22.0 |

It will be seen that all three polymers gave significant benefits even at 0.01 g/litre.

EXAMPLE 7

In this Example the foam enhancement benefits of various acrylic polymers were investigated. The polymer level was 0.1 g/litre in each case, and the active detergents and their levels were as in Example 3. The results were as follows:

| Polymer | Chemical type | NSI score difference |
|---|---|---|
| Versicol S25 | Linear sodium polyacrylate | +8.75 |
| Versicol W25 | Linear polyacrylamide | +5.0 |
| Crosfloc CFA-80 | Linear sodium acrylate/acrylamide copolymer | +4.0 |
| Carbopol 941 | Sodium polyacrylate (crosslinked) | +4.0 |

EXAMPLE 8

The procedure of Example 7 was repeated using an ethylene-maleic anhydride copolymer, EMA 91 ex Monsanto; the NSI score difference was +5.0.

EXAMPLE 9

The procedure of Example 7 was repeated using xanthan gum, Kelzan S. The NSI score difference was +4.0.

EXAMPLE 10

In this Example the viscosity-increasing effect of the cellulosic polymer Natrosol 250 HBR on liquid detergent composition containing dialkyl sulphosuccinate was investigated.

A base solution was prepared containing 5.5% dialkyl sulphosuccinate, 11.5% urea, 0.15% perfume and 0.2% formalin. The polymer was added to the base solution at levels of 0.3, 0.5 and 0.75% by weight, and the viscosity at each level, at 25° C. and 26.5 $s^{-1}$ applied shear, was measured using a Haake viscometer. The results were as follows:

| Polymer level (weight %) | Viscosity (cp) |
|---|---|
| 0 | (about 2) |
| 0.30 | 56.0 |
| 0.50 | 244.0 |
| 0.75 | 688.0 |

It will be seen that for this polymer a level of 0.5% gave excellent results while a level of 0.3% was inadequate. For a hand dishwashing product the level of 0.75% would be high, although this might be appropriate for other types of product. The viscosity in the absence of polymer was too low for accurate measurement.

EXAMPLE 11

The procedure of Example 10 was repeated using the polymers Kelzan S (xanthan gum) and Carbopol 941 (crosslinked sodium polyacrylate) identified previously. The results were as follows:

| Polymer | Polymer level (weight %) | Viscosity (cp) |
|---|---|---|
| Kelzan S | 0.30 | 120.0 |
| | 0.50 | 264.0 |
| | 0.75 | 488.0 |
| Carbopol 941 | 0.30 | 40.0 |
| | 0.50 | 144.0 |
| | 0.75 | 368.0 |

For Carbopol 941 the 0.3% level was too low, but for Kelzan S this level gave a good result.

EXAMPLE 12

The procedure of Example 10 was repeated using a more concentrated base solution containing 10% by weight of the dialkyl sulphosuccinate mixture, 5% by weight of alkyl ether sulphate (2EO, sodium salt) and 8% by weight of urea. The polymer, Natrosol 250 HBR, was used at levels of 0.4 and 0.8% by weight. The results were as follows:

| Polymer level (weight %) | Viscosity (cp) |
|---|---|
| 0 | 12 |
| 0.4 | 232 |
| 0.8 | 896 |

A polymer level of 0.4% gave an excellent viscosity value of 232 cp, while the value of 896 cp obtained using 0.8% polymer was higher than optimum for a dishwashing liquid although possibly appropriate for other types of product. The low temperature stability of the composition was not adversely affected by polymer at either level.

EXAMPLE 13

The procedure of Example 12 was repeated using a slightly different base solution. This contained 7.5% by weight of dialkyl sulphosuccinate, 3.75% by weight of alkyl ether sulphate (2EO, sodium salt), 3.75% by weight of coconut diethanolamide (Empilan (Trade Mark) CDE ex Albright & Wilson), 4.6% by weight of urea and 0.15% by weight of perfume. The polymer was again Natrosol 250 HBR. The results were as follows:

| Polymer level (weight %) | Viscosity (cp) |
|---|---|
| 0 | 48 |
| 0.2 | 192 |
| 0.4 | 456 |
| 0.6 | 848 |

With this inherently more viscous base solution, a level of 0.2% by weight of polymer was sufficient to bring the viscosity at 26.5 $s^{-1}$ up to the preferred level of 200 cp.

EXAMPLE 14

A number of different base solutions was prepared as shown in the Table below, in which "SS" indicates dialkyl sulphosuccinate, "AES" indicates alkyl ether sulphate (2EO, sodium salt), "ABS" indicates alkylbenzene sulphonate and "NI" indicates nonionic surfactant.

Each solution contained 2% formalin and 0.15% perfume.

| | Active Detergent | | | | |
|---|---|---|---|---|---|
| Example | SS | ABS | AES | NI | TOTAL |
| 35 | 2.5 | — | — | 1.0 | 3.5 |
| 36 | 3.5 | — | — | 2.0 | 5.5 |
| 37 | 5.5 | — | — | 2.0 | 7.5 |
| 38 | 2.5 | 1.0 | — | — | 3.5 |
| 39 | 3.5 | 2.0 | — | — | 5.5 |
| 40 | 4.0 | 3.5 | — | — | 7.5 |
| 41 | 2.5 | — | 1.0 | — | 3.5 |
| 42 | 3.5 | — | 2.0 | — | 5.5 |
| 43 | 5.5 | — | 2.0 | — | 7.5 |

All of these compositions were in the form of clear, homogeneous solutions of low viscosity, and all could be satisfactorily thickened using 0.2–0.45% by weight of the polymer Natrosol 250 HBR.

We claim:

1. A foaming aqueous liquid detergent composition having a viscosity of at least 60 cp to 2000 cp at 25° C., as measured at a shear rate of 26.5 $s^{-1}$, and consisting essentially of from 2 to 60% by weight of the total composition of an active detergent system comprising a water-soluble salt of a dialkyl ester of sulphosuccinic acid in which the alkyl groups may be the same or different, at least 40% by weight of water, and from 0.5 to 5% by weight of a water-soluble polymer, said polymer being a cellulose ether having hydroxyethyl or hydroxypropyl substituents, said composition being free of quaternary ammonium salts.

2. A foaming aqueous liquid detergent composition having a viscosity of at least 60 cp to 2000 cp at 25° C., as measured at a shear rate of of 26.5 $s^{-1}$, and consisting essentially of from 2 to 60% by weight of the total composition of an active detergent system comprising a water-soluble salt of a dialkyl ester of sulphosuccinic acid in which the alkyl groups may be the same or different, at least 40% by weight of water, and from 0.05 to 5% by weight of a water-soluble polymer, said polymer being a guar having hydrophilic substituents, said composition being free of quaternary ammonium salts.

3. A foaming aqueous liquid detergent composition having a viscosity of at least 60 cp to 2000 cp at 25° C., as measured at a shear rate of 26.5 $s^{-1}$, and consisting essentially of from 2 to 60% by weight of the total composition of an active detergent system comprising a water-soluble salt of a dialkyl ester of sulphosuccinic acid in which the alkyl groups may be the same or different, at least 40% by weight of water, and from 0.05 to 5% by weight of a water-soluble synthetic polymer carrying carboxyl substituents in salt or amide form, said composition being free of quaternary ammonium salt.

4. A foaming aqueous liquid detergent composition having a viscosity of at least 60 cp to 2000 cp at 25° C., as measured at a shear rate of of 26.5 $s^{-1}$, and consisting essentially of from 2 to 60% by weight of the total composition of an active detergent system comprising a water-soluble salt of a dialkyl ester of sulphosuccinic acid in which the alkyl groups may be the same or different, at least 40% by weight of water, and from 0.05 to 5% by weight of a water-soluble polymer, said polymer being a xanthan gum, said composition being free of quaternary ammonium salt.

5. The detergent composition of claim 1 or 2, wherein the polymer is a hydroxypropyl polysaccharide having a level of hydroxypropyl molar substitution of at least 0.18.

6. The detergent composition of claim 1, wherein the polymer is a hydroxyethyl or hydroxypropyl cellulose.

7. The detergent composition of claim 2, wherein the polymer is a hydroxypropyl guar.

8. The detergent composition of claim 3, wherein the polymer is selected from the group consisting of salts of polyacrylic acid, salts of polymethacrylic acid, polyacrylamides, copolymers of acrylic and/or methacrylic acid salts with acrylamide, and ethylene/maleic anhydride copolymers.

9. The detergent composition of claims 1, 2, 3 or 4, which contains from 0.1 to 1.5% by weight of polymer.

10. The detergent composition of claims 1, 2, 3 or 4, having a viscosity within the range of from 70 to 2000 cp at 25° C. and 26.5 $s^{-1}$.

11. The detergent composition of claim 10, having a viscosity within the range of from 100 to 1500 cp at 25° C. and 26.5 $s^{-1}$.

12. The detergent composition of claim 10, having a viscosity of from 200 to 500 cp at 25° C. and 26.5 $s^{-1}$.

13. The detergent composition of claims 1, 2, 3 or 4, which contains from 2 to 30% by weight of active detergent.

14. The detergent composition of claims 1, 2, 3 or 4, which contains from 2 to 20% by weight of active detergent.

15. The detergent composition of claims 1, 2, 3 or 4, wherein the active detergent system comprises dialkyl sulphosuccinate, together with alkyl ether sulphate.

16. The detergent composition of claim 15, wherein the ratio of dialkyl sulphosuccinate to alkyl ether sulphate is at least 1:1.

17. The detergent composition of claim 15, wherein the ratio of dialkyl sulphosuccinate to alkyl ether sulphate is within the range of from 1.5:1 to 5:1.

18. The detergent composition of claims 1, 2, 3 or 4, which contains at least 50% by weight of water.

* * * * *